United States Patent [19]

Otis et al.

[11] Patent Number: 4,883,014

[45] Date of Patent: Nov. 28, 1989

[54] MARINA

[76] Inventors: Roger W. Otis, 308 Bluebird Dr.; Stephen H. Otis, Rte. 2, both of McAlester, Okla. 74501

[21] Appl. No.: 302,099

[22] Filed: Jan. 24, 1989

Related U.S. Application Data

[63] Continuation of Ser. No. 925,726, Oct. 31, 1986, abandoned.

[51] Int. Cl.[4] ..... B63B 35/72

[52] U.S. Cl. ..... 114/263

[58] Field of Search ..... 114/263, 266, 267; 52/650, 690, 811, 648; 14/2.6, 27; 405/218–222

[56] References Cited

U.S. PATENT DOCUMENTS

| | | | |
|---|---|---|---|
| 3,022,759 | 2/1962 | McCall | 114/266 |
| 3,024,753 | 3/1962 | Benson, Jr. | 114/263 |
| 3,215,108 | 6/1965 | Otis | 114/5 |
| 3,287,919 | 11/1966 | Hahn | 405/218 |
| 3,289,621 | 12/1966 | Sebring | 114/266 |
| 4,037,420 | 7/1977 | Wicks | 405/218 |
| 4,041,716 | 8/1977 | Thompson | 61/48 |
| 4,051,591 | 10/1977 | Thompson | 29/433 |
| 4,418,634 | 12/1983 | Gerbus | 114/263 |
| 4,660,495 | 4/1987 | Thompson | 114/263 |

FOREIGN PATENT DOCUMENTS

| | | | |
|---|---|---|---|
| 480575 | 1/1952 | Canada | 405/218 |
| 2234182 | 1/1975 | France | 114/266 |

OTHER PUBLICATIONS

Dayton Marine Products; "Float Drums".
Cox, "Choosing a Floating Dock", 1976.
Marinas Internationale Ltd., brochure, undated.
Meeco Marinas Inc., "Meeco Marinas", published more than one year before filing date.
Meeco Marinas Inc., "The Admiral", published more than one year before filing date.
Meeco Marinas Inc., "The Captain", published more than one year before filing date.
Meeco Marinas Inc., "The Commodore", published more than one year before filing date.
Meeco Marinas Inc., "The Mariner", published more than one year before filing date.
Thompson Flotation Company, Technical Data, 1977.
Thompson Flotation, Inc., "Thompson Floating Docks Standard Framing Systems", 1983.
Thompson Flotation, Inc., "Thompson Fiber-Cement Non Skid Deck", 1984.

*Primary Examiner*—Joseph F. Peters, Jr.
*Assistant Examiner*—Edwin L. Swinehart

[57] ABSTRACT

A marina having a main walk buoyantly supported on main flotation elements, with the main walk providing access to one or more finger sections buoyantly supported on finger flotation elements. The main walk and the finger sections are each formed from spaced frame members having sunken shoulders which support transversely extending deck elements which define walking surfaces flush with the frame members. Each main frame member may be formed from a plurality of main frame elements disposed in end-to-end abutment. Each pair of main frame elements is joined by a structural element having spaced main frame plates which may engage each main frame member of the main walk. The main frame plates may be interconnected at their edges by a tying member which extends below the main walk.

12 Claims, 5 Drawing Sheets

MARINA

This is a continuation of co-pending application Ser. No. 925,726 filed on Oct. 31, 1986 abandoned.

FIELD OF THE INVENTION

The present invention relates generally to floating boat docks.

SUMMARY OF THE INVENTION

The present invention is a marina comprising a main walk which in turn comprises a plurality of spaced, elongate, non-metallic main frame members and at least one main walking surface supported by at least two of the main frame members. The main walk further comprises a structural element comprising a plurality of metallic main frame plates, at least equal in number to the main frame members, with each main frame plate engaging a main frame member. The main walk further comprises means for securing each main frame plate to its corresponding main frame member, and means, extending beneath the main frame members, for spacing and maintaining the main frame plates in fixed spatial relationship. Means are provided for buoyantly supporting the main walk above a body of water.

Also comprising the present invention is a kit for assembly of at least a portion of a marina comprising a plurality of elongate, non-metallic first main frame elements and a structural element comprising a plurality of main frame plates, each main frame plate engageable with a corresponding first main frame element. The structural element further comprises means, extendable beneath the first main frame elements, for spacing and maintaining the main frame plates in fixed spatial relationship.

Also comprising the present invention is a method of assembling at least a portion of a marina comprising positioning a plurality of elongate first main frame elements in spaced relationship by a structural element positioned so that each main frame plate engages a first main frame element, and such that the means for maintaining the main frame plates in fixed spatial relationship is positioned below the first main frame elements. Each main frame plate is secured to its corresponding first main frame element.

The marina fendering is not shown, in order to permit better display of other components.

Figure 1:
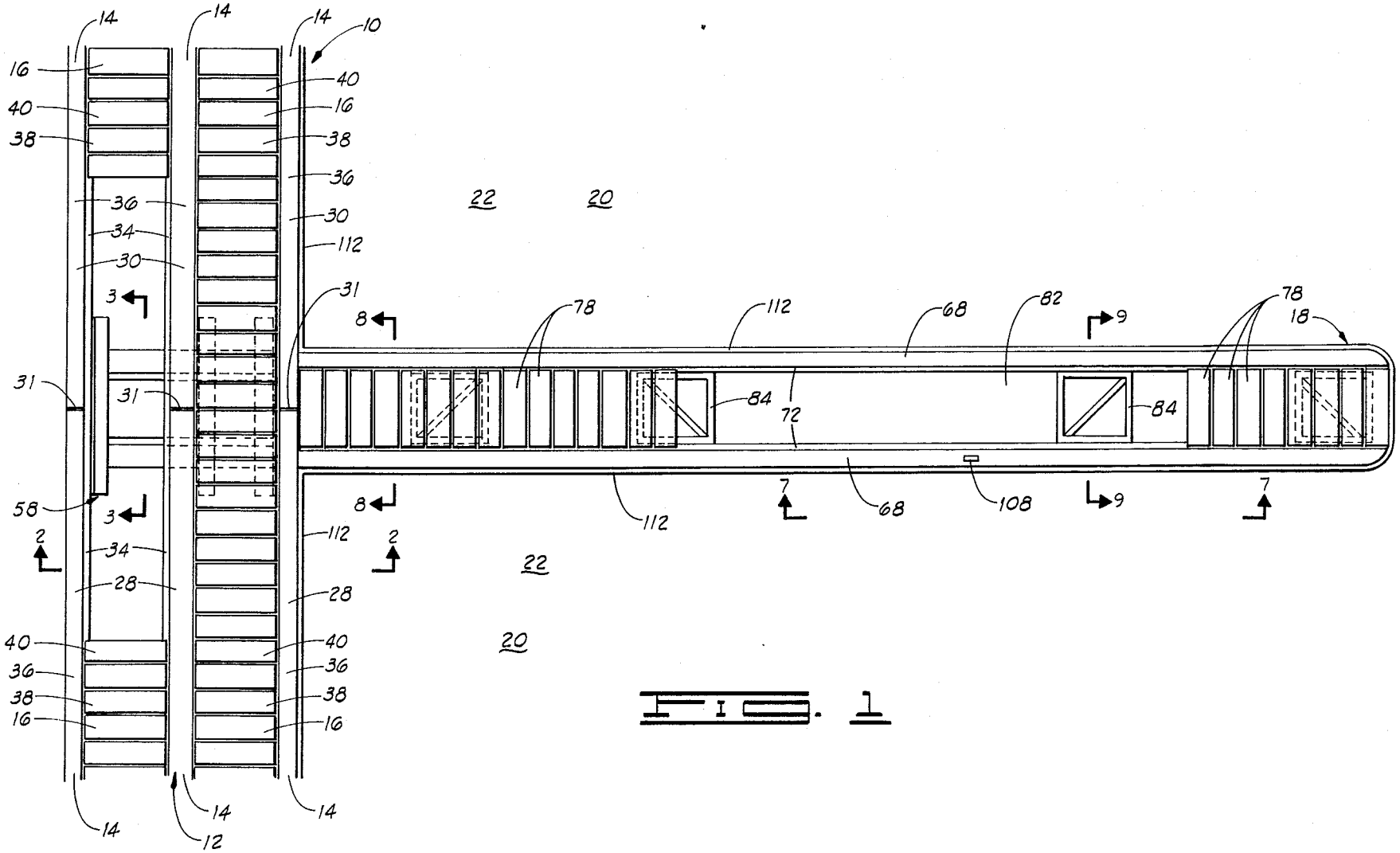
FIG. 1 is a partial plan view of the marina of the present invention. A portion of the main walking surface has been removed, in order to permit better display of other components.
Figure 9:
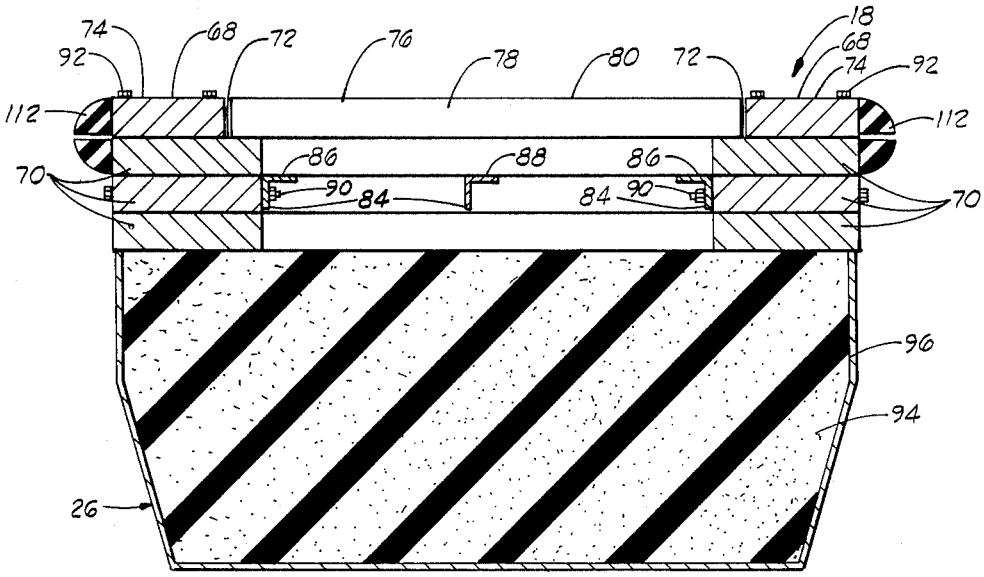

FIG. 9 is a cross-sectional view of the finger section of the marina shown in FIG. 1, taken along line 9—9.

Figure 10:
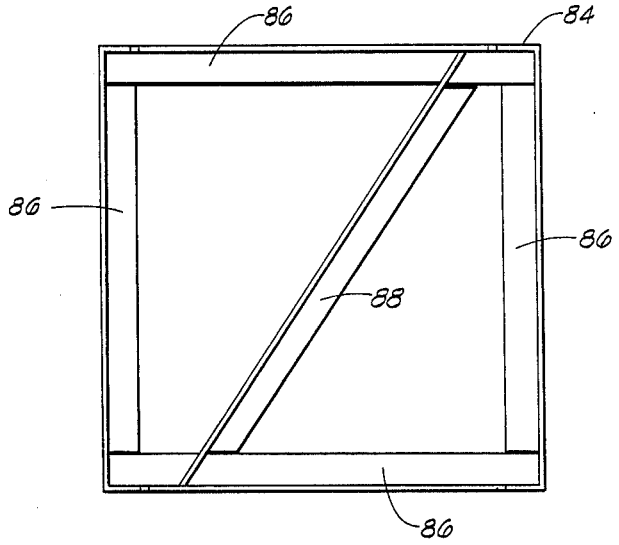

FIG. 10 is a bottom view of the finger truss used in the finger section of the marina of the present invention.

Figure 11:
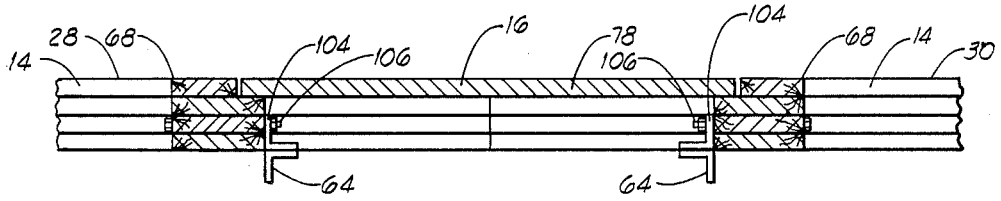

FIG. 11 is a cross-sectional view of the finger section of another embodiment of the present invention, taken from a position corresponding to that of line 8—8 in FIG. 1. The marina fendering is not shown in this view, in order to permit better display of other components.

DETAILED DESCRIPTION OF THE PREFERRED EMBODIMENTS

With reference to FIG. 1, the marina of the present invention, generally designated by reference numberal 10, comprises a main walk 12, which is formed from a plurality of spaced, elongate main frame members 14 of equal length, on which are supported at least one, and preferably a plurality of main walking surfaces 16. In the embodiment shown in the Figures, the main frame members are disposed in parallel relationship by tying member 64 of structure 58 shown in FIGS. 4 through 6.

The main walk 12 provides pedestrian access, on either or both of its sides, to a plurality of finger sections 18, of which one is shown in the Figures. The finger sections 18 are joined to the main walk 12, and project laterally therefrom, preferably in orthogonal relationship to the main walk 12. Adjacent finger sections 18 disposed on the same side of the main walk 12 define slips 20 within which watercraft may be docked. When the marina 10 is positioned above a body of water 22, main flotation elements 24 (shown in FIG. 2) function to buoyantly support the main walk 12 above the body of water 22, while finger flotation elements 26 (shown in FIGS. 7 and 9) function to buoyantly support each finger section 18 above the body of water 22.

Figure 2:
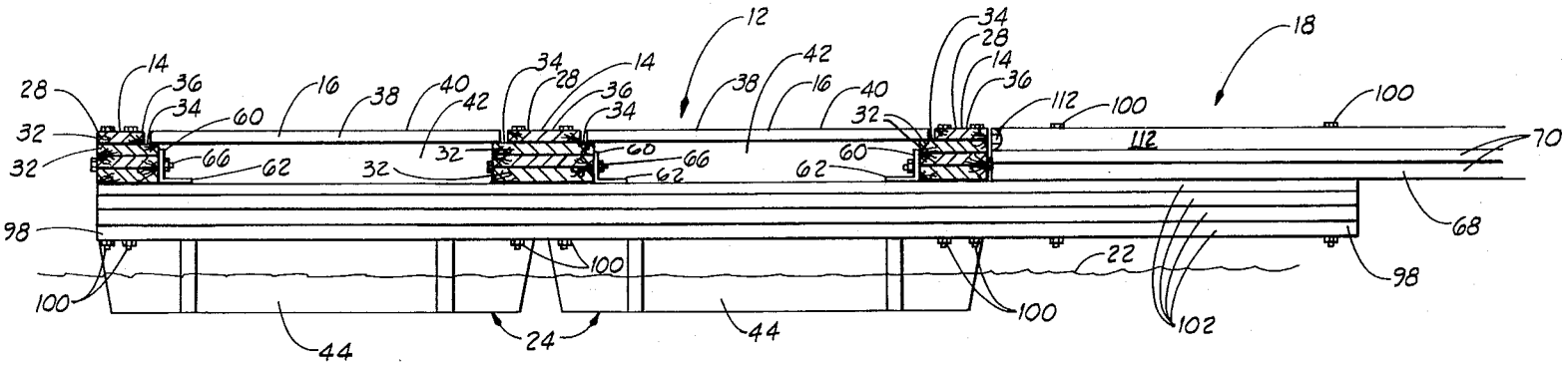
FIG. 2 is a cross-sectional view of the main walk and finger section of the marina shown in FIG. 1, taken along line 2—2.
Figure 3:
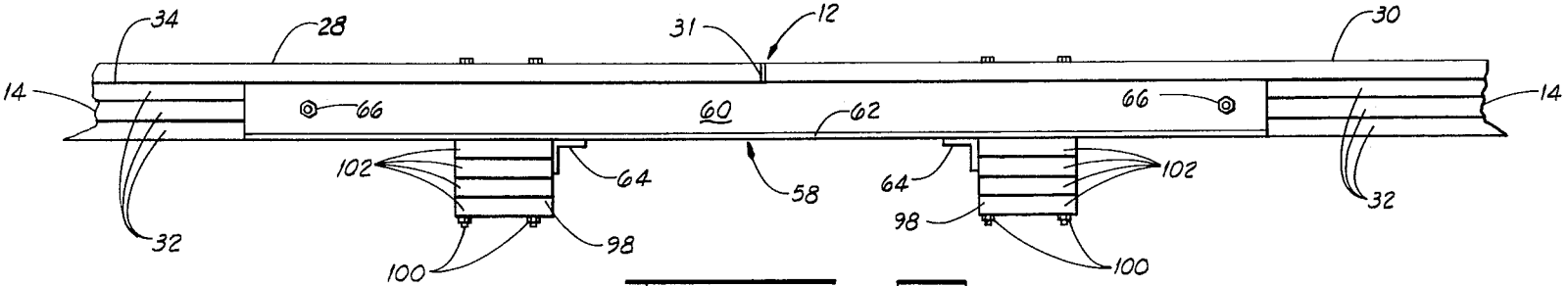
FIG. 3 is a cross-sectional view of the main walk of the marina shown in FIG. 1, taken along line 3—3.

With reference to FIGS. 2 and 3, the main walk 12 shown therein is formed from three main frame members 14; however, any plural number of main frame members 14 may be used, as dictated by the size and structural requirements to be satisfied by the marina 10. The main frame members 14 preferably are formed from a sturdy, corrosion-resistant, non-metallic material, such as lumber, and more preferably are formed from a lumber such as Douglas fir, cedar or southern yellow pine. In one preferred embodiment of the marina 10 of the present invention, the main frame members 14 are characterized by cross-sectional dimensions of between about 5 inches and about 6 inches by between about 7 inches and about 12 inches. When the main frame members 28 are formed from lumber, they preferably are treated with a water-resistant preservative coating, such as chromated copper arsenate.

In the embodiment shown in FIG. 1, each main frame member 14 is formed from a plurality of discrete, elongate main frame elements, preferably of identical length, of which a first main frame element 28 and a second main frame element 30 are shown. In the embodiment shown in the Figures, these main frame elements are positioned in collinear, end-to-end abutment, preferably such that areas of abutment 31 of adjacent end-to-end pairs of main frame elements are substantially coplanar. Adjacent end-to-end pairs of main frame elements are joined by structural elements, to be described hereafter, to form a unitary main frame member 14. Formation of each main frame member 14 from plural main frame elements offers advantages in convenience of assembly and transportation. Alternately, however, each main frame member 14 may comprise a single, integral, main frame element. In a preferred embodiment of the marina 10 of the present invention, each main frame element is formed from a plurality of elongate timbers 32 which are stacked in face-to-face engagement. A waterproof adhesive material, such as resorcinol glue, is used to laminate the stacked timbers 32 into a beam-like configuration.

As shown in FIG. 2, at least two main frame members 14, and preferably each adjacent pair of main frame members 14, are characterized on adjacent lateral sizes thereof by a longitudinally extending shoulder 34. The shoulder 34 is positioned adjacent the upper portion of its main frame member 14, but at a level below the upper surface 36 thereof. When the main frame elements comprising each main frame member 14 are formed from a laminated stack of elongate timbers 32, as described above, each main frame element preferably comprises an uppermost timber having a lesser width than the remaining timbers making up the main frame element. With such a configuration, the shoulder 34 is defined by the side edge of the uppermost timber and by the upper surface of the next lowest timber forming the main frame element. As shown in FIG. 2, when the main walk 12 comprises more than two main frame members 14, then the main frame members 14 intermediate the lateral edges of the main walk 12 preferably are characterized by two parallel shoulders 34 extending laterally on each side thereof.

Supported by at least two of the main frame members 14, and preferably by each adjacent pair of main frame members 14, is the main walking surface 16, which extends along the entire length of the main walk 12. Thus, when the main walk 12 is formed from three main frame members 14, as shown in FIG. 2, there are two main walking surfaces 16: one for each adjacent pair of main frame members 14. Each main walking surface 16 preferably is formed from a plurality of deck members 38, disposed in edge-to-edge engagement to define a substantially linear, continuous surface suitable for use by pedestrians.

The deck members 38 preferably are characterized by substantially identical dimensions, and preferably are formed from a sturdy, corrosion-resistant, non-metallic material, such as lumber. In one embodiment, the deck members 38 are formed from a lumber such as Douglas fir, cedar or southern yellow pine, preferably treated with a water-resistant preservative coating, such as chromated copper arsenate. In one such preferred embodiment of the marina 10 of the present invention, the deck members 38 comprise timbers having dimensions of 2 inches by 8 inches by 25 inches. Alternately, the deck members 38 may comprise preformed panels of concrete, fiberglass, or exposed aggregate.

Each main walking surface 16, and each deck member 38 comprising each main walking surface 16, are supported by adjacent shoulders 34 formed in adjacent main frame members 14. Preferably, each deck member 38 is oriented transversly to the length of the main walk 12, with one end thereof supported by the shoulder 34 of one main frame member 14, and the other end supported by the adjacent shoulder 34 of an adjacent main frame member 14. The deck members 38 are secured to the main frame members 14 by fasteners (not shown), such as nails. As shown in FIG. 2, each main walking surface 16, and thus each deck member 38, are characterized by a thickness such that the upper surface 40 of the main walking surface 16 is substantially flush with the upper surfaces 36 of the adjacent pair of main frame members 14 which support the main walking surface 16. Thus, the upper surface of the main walk 12 is substantially planar.

The planar configuration of the main walk 12, which enhances pedestrian safety, is made possible by the positioning of the supporting shoulders 34 at a level below the upper surface 36 of the main frame members 14. These sunken shoulders 34 also permit convenient installation of non-wooden deck members 38 such as preformed concrete panels. Without the sunken shoulders 34, such non-wooden panels would be difficult to secure to the upper surfaces 36 of the main frame member 14 in such a way as to establish a planar surface for the main walk.

As shown in FIG. 2, the main walk 12 is characterized by at least one inner conduit 42 extending beneath the main walking surface 16 and parallel thereto along the length of the main walk 12. The inner conduit 42 is defined by the adjacent sides of adjacent main frame members 14 and by the underside of the main walking surface 16. Preferably, an inner conduit 42 is formed between each adjacent pair of main frame members 14 forming the main walk 12. Utility lines, such as those providing electricity and water, may be positioned within one or more of the inner conduits 42 in order to provide utility access throughout the length of the main walk 12. Access to the inner conduit 42, as required for repair or replacement of utility lines, may be provided by removal of the overlying deck member or deck members 38 at the desired access point.

With continued reference to FIG. 2, main flotation elements 24 are secured to the underside of the main frame members 14 by fasteners (not shown), such as bolts. Preferably, when the main walk 12 comprises more than two main frame members 14, the main flotation elements 24 are positioned in side-by-side relationship across the width of the main walk 12, with one main flotation element 24 secured below one pair of adjacent main frame members 14, another main flotation element 24 secured below the next adjacent pair of main frame members 14, and so on. Main flotation elements 24 preferably are also positioned again in side-by-side relationship, at spaced positions along the length of the main walk 12. The spacing and total number of main flotation elements 24 underlying the main walk 12 will be dictated by the freeboard requirements of the marina 10.

In the embodiment shown in the Figures, the main flotation elements 24 comprise polystyrene which has been expanded in a unitary polyethylene case 44. Alternately, the main flotation elements 24 may comprise exposed blocks of polystyrene, such as those described in U.S. Pat. No. 3,215,108, which are secured by bolts to the underside of the main frame members 14. With either embodiment, it will be noted that the main flotation elements 24 are of compact construction, so that the main flotation elements 24 do not obstruct the inner conduits 24 formed in the main walk 12.

Figure 4:
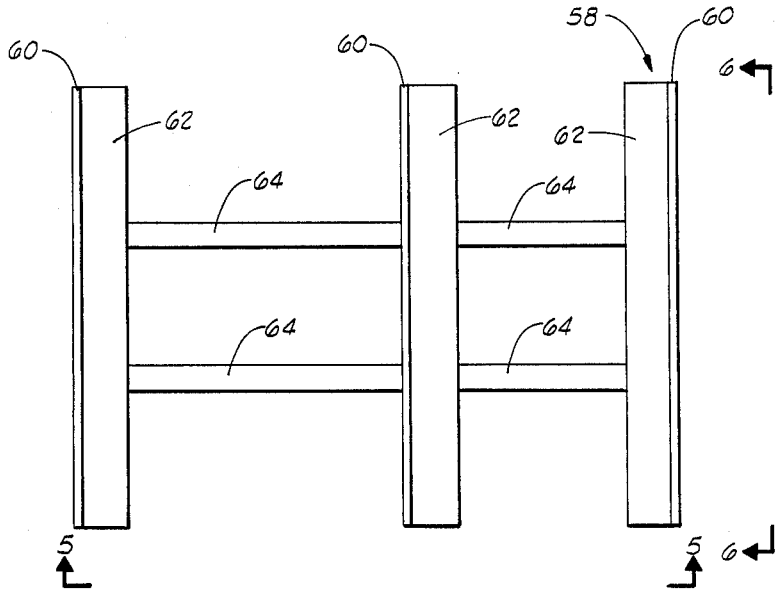
FIG. 4 is a plan view of the structural element used in the marina of the present invention.
Figure 5:
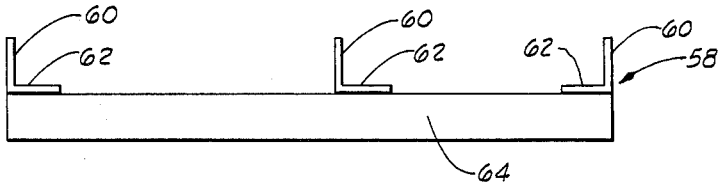
FIG. 5 is a front elevational view of the structural element shown in FIG. 4, taken along line 5—5.
Figure 6:
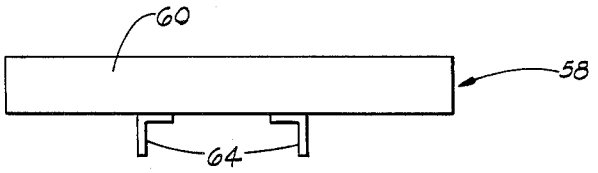
FIG. 6 is a side elevational view of the structural element shown in FIG. 4, taken along line 6—6.

With reference to FIG. 1, the main walk 12 further comprises a structural element 58, which spaces and maintains the main frame members 14 in spaced parallel relationship, which imparts structural strength to the main walk 12, and which may further function to join abutting main frame elements comprising the main frame members 14 of the main walk 12. As best shown in FIGS. 4, 5 and 6, the structural element 58 comprises a plurality of metallic frame plates 60, formed from a strong, corrosion-resistant material such as hot-dip galvanized steel or aluminum. The metallic frame plates 60 are at least equal in number to the main frame members 14, and preferably are each characterized by identical dimensions. In the embodiment shown in the Figures, the main frame plates 60 are disposed in spaced, parallel and overlying relationship.

In order to facilitate interconnection of the main frame plates 60, each main frame plate 60 preferably is secured at the same selected edge thereof to a base plate 62 extending perpendicularly to the main frame plate 60. The base plate 62 preferably is formed from the same material as the main frame plate 60. As shown in FIGS. 4 and 5, each main frame plate 60 and base plate 62 combination may comprise legs of a unitary member, such as an L-shaped angle iron.

Interconnecting the plurality of main frame plates 60 and maintaining the the main frame plates 60 in fixed spatial relationship are at least one and preferably a plurality of tying members 64 which preferably are formed from the same material as the main frame plates 60. In the embodiment shown in the Figures, the tying members 64 extend in parallel relationship to each other, and in perpendicular relationship to the main frame plates 60. The tying members 64 are positioned adjacent the same selected edge of each main frame plate 60, and preferably are secured, as by welding, to the base plate 62 of each main frame plate 60. While separate tying members 64 may be used to interconnect each adjacent pair of main frame plates 60, it is preferred that each tying member 64 interengage all of the main frame plates 60 comprising the structural element 58. As best shown in FIG. 6, it is preferred that each tying member 64 comprise an elongate L-shaped angle iron.

As shown in FIGS. 1, 2 and 3 the main frame plates 60 of the structural element 58 are spaced so that each main frame plate 60 engages the sides of a main frame member 14, preferably adjacent the area of abutment 31 of two main frame elements, such as the first main frame element 28 and the second main frame element 30. Preferably, a different main frame member 14 is engaged by each main frame plate 60. Fasteners 66, such as bolts, function to secure each main frame plate 60 to its corresponding main frame member 14, preferably so that each main frame plate 60 holds an abutting pair of first and second main frame elements in fixed engagement. While only two bolts 66 are shown in the Figures, it should be understood that additional bolts will ordinarily be provided to secure each main frame plate 60 to its main frame member 14. When the structural element 58 is installed as described above, the tying members 64 of the structural element 58 extend beneath the main frame members 14, and maintain the main frame plates 60 in fixed spatial relationship. Because the tying members 64 engage the lower edge of the main frame plates 60, they do not obstruct the inner conduits 42 formed in the main walk 12.

In the Figures, each main frame member 14 is shown as comprising only two main frame elements, joined by a single structural member 58. However, each main frame member 14 may be formed from any number of main frame elements, with each adjacent pair of main frame elements joined by a structural member as described above. The total length of the main walk 12, and thus the main frame members 14, will be determined by the operating requirements of the marina 10. In a typical embodiment, the main frame members 14 will be between about 12 feet and about 60 feet in length.

As best shown in FIGS. 1, 7, 8 and 9 each finger section 18 comprises a plurality of spaced, parallel, elongate, non-metallic finger frame members 68. While the finger section 18 may comprise any plural number of finger frame members 68, it is preferred that each finger section 18 comprise two finger frame members 68. The first finger frame members 68 should be formed from a sturdy, corrosion-resistant non-metallic material, and preferably are formed from the same material as the main frame members 14. In one preferred embodiment of the marina 10 of the present invention, the finger frame members 68 comprise timbers having cross-sectional dimensions of between about 5 inches and about 6 inches by between about 7 inches and about 8 inches, and a length of between about 35 and about 45 feet. When the finger frame member 68 is lumber, it preferably is treated with a water-resistant protective coating, such as chromated copper arsenate. In a preferred embodiment of the marina 10 of the present invention each of the finger frame members 68 are formed from a plurality of timbers 70 which are stacked in face-to-face engagement. A waterproof adhesive material, such as resorcinol glue, is used to laminate the stacked timbers 70 into a beam-like configuration.

As best shown in FIGS. 1 and 9, at least two of the finger frame members 68, and preferably each adjacent pair of finger frame members 68 are each characterized, on adjacent lateral sides thereof, by a longitudinally extending shoulder 72. The shoulder 72 is positioned adjacent the upper portion of its finger frame member 68, but at a level below the upper surface 74 thereof. When the finger frame member 68 is formed from a laminated stack of elongate timbers 70, as described above, it preferably comprises an uppermost timber having a lesser width than the remaining timbers making up the finger frame member 68. With such a configuration, the shoulder 72 is defined by the side edge of the uppermost timber and by the upper surface of the next lowest timber in forming the finger frame member 68. When the finger section 18 comprises more than two finger frame members 68, those finger frame members 68 intermediate the lateral edges of the finger section 18 preferably are characterized by two parallel shoulders 72 extending laterally on each side thereof.

Figure 8:
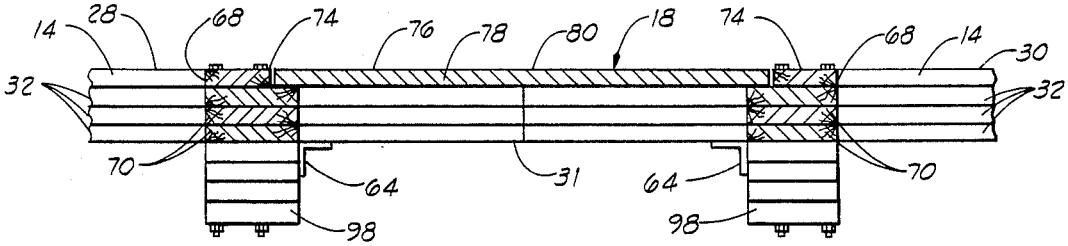
FIG. 8 is a cross-sectional view of the finger section of the marina shown in FIG. 1, taken along line 8—8.

Supported by at least two of the finger frame members 68, and preferably by each adjacent pair of finger frame members 68, is a finger walking surface 76 extending along the entire length of the finger section 18. Thus, when the finger section 18 consists of two finger frame members 68, as shown in FIGS. 8 and 9, there is one finger walking surface 76. Each finger walking surface 76 preferably is formed from a plurality of deck members 78 disposed in edge-to-edge engagement to define a substantially linear, continuous surface suitable for use by pedestrians.

The deck members 78 preferably are characterized by substantially identical dimensions, and preferably are formed from a sturdy, corrosion-resistant, non-metallic material, such as lumber. In one embodiment, the deck members 78 are formed from a lumber such as Douglas fir, cedar or southern yellow pine, preferably treated with a water-resistant preservative coating, such as copper chormate arsenite. In one such preferred embodiment of the marina 10 of the present invention, the deck members 78 comprise timbers having dimensions of 2 inches by 8 inches by 25 inches. Alternately, the deck members 78 may comprise preformed panels of concrete, fiberglass, or exposed aggregate.

Each finger walking surface 76 and each deck member 78 comprising the finger walking surface 76 are supported by adjacent shoulders 72 formed in adjacent finger frame members 68. Preferably, each deck member 78 is oriented transversely to the length of the finger section 18, with one end thereof supported by the shoulder 72 of one finger frame member 68 and the other end supported by the adjacent shoulder 72 of an adjacent finger frame member 68. The deck members 78 are secured to the finger frame members 68 by fasteners (not shown), such as nails.

As best shown in FIGS. 8 and 9, each finger walking surface 76 and thus each deck member 78 are characterized by a thickness such that the upper surface 80 of the finger walking surface 76 is substantially flush with the upper surfaces 74 of the adjacent pair of finger frame members 68 which support the finger walking surface 76. Thus, the upper surface of the finger section 18 is substantially planar.

As best shown in FIG. 1, the finger section 18 is characterized by at least one inner conduit 82 extending beneath the finger walking surface 76 and parallel thereto along the length of the finger section 18. The inner conduit 82 is defined by the adjacent sides of adjacent finger frame members 68 and by the underside of the finger walking surface 76. Preferably, an inner conduit 82 is formed between each adjacent pair of finger frame members 68 forming the finger section 18.

As shown in FIGS. 1, 8 and 9, at least one, and preferably a plurality of rectangular finger trusses 84 are installed within each inner conduit 82 of each finger section 18. Each finger truss 84 imparts structural strength to the finger section 18 and functions to resist twisting movements applied to the finger section 18 by wave and wind action, thereby reducing the need for external anchorage, such as pilings. Preferably, each finger truss 84 is formed from a strong, corrosion-resistant material such as hot-dip galvanized steel or aluminum. As shown in FIG. 10, each finger truss 84 preferably is formed from L-shaped angle irons, forming truss sides 86, which have been welded together to form a frame-like rectangular structure. Each finger truss 84 preferably further comprises a diagonally extending bracing member 88.

With reference to FIGS. 1, 8 and 9, each finger truss 84 is positioned in parallel, underlying relationship to the finger walking surface 76 within the inner conduit 82. The finger truss 84 is sized so that one truss side 86 engages one finger frame member 68 and the opposite truss side 86 engages the adjacent finger frame member 68 defining the inner conduit 82. Fasteners 90, such as bolts, function to secure each engaging truss side 86 to the side of its adjacent finger frame member 68. The number and spacing of the finger trusses 84 will be dictated by the structural requirements of the finger section 18. In general, the finger trusses 84 will be spaced more closely adjacent the main walk 12.

Figure 7:
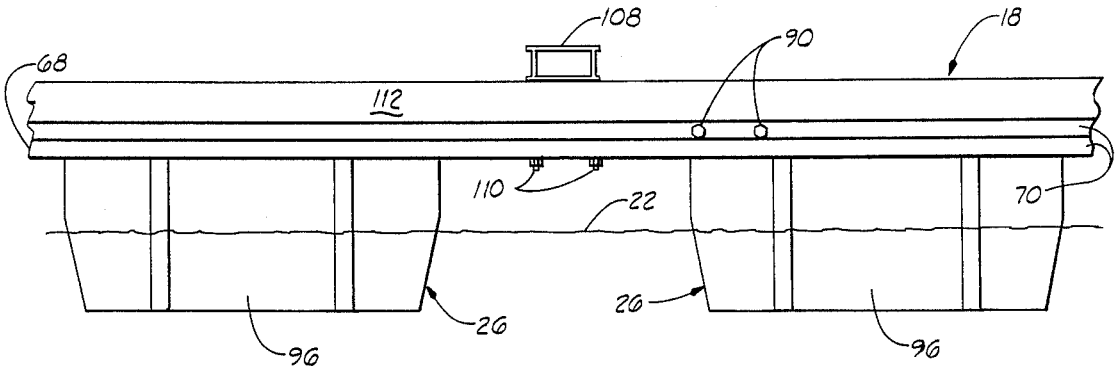
FIG. 7 is a partial elevational view of the finger section of the marina shown in FIG. 1, taken along line 7—7.

As shown in FIGS. 7 and 9, finger flotation elements 26 are secured to the underside of the finger frame members 68 by fasteners 92, such as bolts, in the same configuration used for positioning main flotation elements 24 under the main walk 12. Thus, if the finger section 18 comprises more than two finger frame members 68, the finger flotation elements 26 preferably are positioned in side-by-side relationship across the width of the finger section 18. Finger flotation elements 26 are positioned along the length of each adjacent pair of finger frame members 68 comprising the finger section 18, preferably in side-by-side relationship if the finger section 18 comprises more than two finger frame elements 68. The spacing and total number of finger flotation elements 26 underlying each finger section 18 will be dictated by the freeboard required for the marina 10.

In the embodiment shown in FIGS. 7 and 9, the finger flotation elements 26 comprise polystyrene 94 which has been expanded in a unitary polyethylene case 96. Alternately, the finger flotation elements 26 may comprise exposed blocks of polystyrene, such as those described in U.S. Pat. No. 3,215,108, which are secured by bolts to the underside of the finger frame members 68.

As shown in FIGS. 2, 3 and 8, the finger section 18 further comprises a plurality of tie beams 98, which function to maintain each finger frame member 68 in orthogonal abutment with the main walk 12. In the embodiment shown in the Figures, the finger frame members 68 are positioned in orthogonal relationship to the main walk 12. Preferably, the tie beams 98 are equal in number to the finger frame members 68. Each tie beam 98 extends in underlying, engaging relationship between a portion of a finger frame member 68 and at least a portion, and preferably all, of the main walk 12. Fasteners 100, such as bolts, secure each tie beam 98 to its overlying finger frame member 68 and to the overlying main frame members 14 of the main walk 12.

The tie beams 98 preferably are formed from a sturdy, corrosion-resistant material such as lumber, and more preferably are formed from a lumber such as Douglas fir, cedar, or southern yellow pine. In one preferred embodiment, the tie beams 98 are formed from a plurality of elongate timbers 102 which are stacked in face-to-face engagement. A waterproof adhesive material, such as resorcinol glue, is used to laminate the stacked timbers 102 into a beam-like configuration. In one preferred embodiment of the marina 10 of the present invention, the tie beams 98 are characterized by cross-sectional dimensions of between about 5 inches and 6 inches and between about 7 inches and 8 inches. When the tie beams 98 are formed from lumber, they preferably are treated with a water-resistant preservative coating, such as chromated copper arsenate.

FIG. 11 is a view taken from a position comparable to that of FIG. 8, and shows an alternate constructon for maintaining each finger frame member 68 in fixed, orthogonal abutment with the main walk 12. In the embodiment shown in FIG. 11, the tie beams 98 are not used. Instead, orthogonal abutment is maintained by a plurality of metallic finger plates 104, at least equal, and more preferably equal, in number to the finger frame members 68. Each finger plate 104 is supported on the structural element 58. Preferably, each finger plate 104 comprises one leg of an L-shaped angle iron, and preferably is formed from the same material as the structural element 58.

When the structural element 58 is in its installed position underlying the main walk 12, the finger plates 104 are laterally offset from the main walk 12, and are oriented in parallel relationship to each other, while extending perpendicularly with respect to the length of the main walk 12. Each finger plate 104 engages a corresponding finger frame member 68, and is secured thereto by fasteners 106, such as bolts. Because the finger plates 104 extend perpendicularly to the main walk 12, they function to retain the finger frame members 68, and thus the finger section 18, in orthogonal abutment with the main walk 12.

A preferred construction for the finger plates 104, shown in FIG. 11, is formed by providing at least as many tying members 64, comprising angle irons, as there are finger frame members 68 in the finger section 18. The tying members 64 should be extended to termination points beyond the main frame plate 60 positioned closest to the finger section 18, so that the tying members 64 terminate at a point offset from the main walk 12 when the structural element 58 is installed. The finger plates 104, which may comprise legs of L-shaped angle irons, may be secured to the extended tying members 64, as by welding.

The components of the main walk 12 and each finger section 18 should be sized, and the freeboard of the main walk 12 and each finger section 18 should be selected, so that the upper surfaces of the finger section 18 and the main walk 12 are substantially flush at areas of abutment. While only one finger section 18 has been shown in the Figures, it should be understood that one or more additional finger sections 18 may be secured to the main walk 12, along either or both sides thereof, in the same manner as described with reference to the embodiment shown in the Figures. Likewise, these additional finger sections may be supported by finger flotation elements in the same manner as described previously.

As shown in FIGS. 1 and 7, one or more cleats 108 may be secured to the finger frame members 68 by fasteners 110, such as bolts. Watercraft within the slips 22 of the marina 10 may be moored to these cleats 108. In order to protect the marina 10 from collisions with watercraft within the slips 22, it is preferred to attach fendering 112 to the main finger frame members 14 and 68, defining the slips 22, as shown in FIGS. 1, 2, 7 and 9. The fendering 112 preferably is formed from a strong, resilient, water-resistant material, such as vinyl plastic.

In the embodiment described with reference to the Figures, the structural element 58 functions to join adjacent main frame elements forming the main frame members 14. However, it should be understood that structural elements 58 may be installed at locations along the main walk 12 other than at areas of abutment between main frame elements, if required for strengthening the main walk 12, or for facilitating the attachment of finger sections 18, as described with reference to the embodiment shown in FIG. 11.

In the event that external anchorage is required for the marina 10, pilings (not shown) may be secured to the marina 10, preferably adjacent the opposite ends of the finger sections 18 and along the main walk 12 intermediate the finger sections 18. The required configuration of pilings will be dictated by the depth, waves, currents, shoreline, bottom conditions and prevailing tides in the body of water 22 in which the marina 10 is installed.

In the embodiment shown in the Figures, the main walk 12 is a linear structure, formed from parallel main frame members 14. When the main frame members 14 are formed from plural main frame elements, the adjoining main frame elements are joined in collinear, end-to-end abutment by a structural element 58 having planar main frame plates 60. In another embodiment, not shown in the Figures, the main walk may comprise a non-linear structure, such as a structure formed in the shape of a circle, polygon, or a section thereof. In such an embodiment, each main frame member is non-linear, and preferably is formed from a plurality of abutting, but non-collinear, main frame elements.

When the main walk is a non-lineal structure, the abutting main frame elements preferably are joined by a structural element in which each main frame plate is characterized by a contour matching that of the main walk. Thus, when the main walk comprises a circle, polygon, or section thereof, each main frame plate may be formed from sections, preferably joined together at an angle matching that defined by the main walk. In such an embodiment, a tying member preferably underlies each corresponding set of main frame plate sections. In general, adjacent tying members will not be parallel, in contrast to the embodiment shown in the Figures.

The components of the marina 10 of the present invention may be assembled as a kit, which may be transported to the site where the marina 10 is to be assembled and installed. The kit should comprise a plurality of first main frame elements 28, preferably a plurality of second main frame elements 30, at least one structural element 58, a plurality of finger frame members 68, preferably at least one finger truss 84, deck members 58 and 78, main flotation elements 24 and finger flotation elements 26. The exact number of each component provided in the kit will be dictated by the size and operating requirements of the marina 10 to be assembled.

At least a portion of the marina 10 preferably is assembled on the shoreline adjacent the body of water 22 in which the marina 10 is to be installed. Initially, a plurality of first main frame elements 28, one from each first main frame member 14, are positioned in spaced relationship. Preferably, a plurality of second main frame elements 30, equal in number to the first main frame elements 28, are positioned in spaced relationship, such that each second main frame element 30 is disposed in end-to-end abutment with a first main frame element 30.

The structural element 58 is positioned so that each main frame plate 64 engages the first main frame element 28, and preferably engages a pair of abutting first and second main frame elements 28 and 30 adjacent the area of aubtment 31, and so that the tying members 64 are positioned below the first main frame members 14, and preferably the first and second main frame elements 28 and 30. Each main frame plate 64 is secured to its corresponding first main frame element 28, and preferably also to the abutting second main frame element 30 by fasteners 66. Additional main frame elements may be assembled with additional structural elements in the same manner as described above, to form fully assembled main frame members 14 comprising the main walk 12. Main flotation elements 24 may be secured to the underside of the main walk 12, either after it is fully assembled, or as the sections thereof are assembled.

A finger section 18 is assembled by positioning a plurality of finger frame members 68 in spaced parallel relationship. Finger trusses 84 are installed by fasteners 90 to the finger frame members 68 and finger flotation elements 26 are secured to the underside of the finger frame members 84 with fasteners 92. The finger section 18 then is positioned so that each finger frame member 84 abuts the main walk 12. The finger section 18 is joined to the main walk 12 either by tie beams 98 and fasteners 100, or by finger plates 104 and fasteners 106. Additional finger sections 18 may be assembled and joined to the main walk 12 in like manner.

After the main walk 12, finger sections 18, and main and finger flotation elements 24 and 26 are assembled on land as described above, the assembled components are moved into the body of water 22 and anchored by pilings, if necessary. Utility lines may be installed within the inner conduit 42 of the main walk 12, and the main and finger walking surfaces 16 and 76 installed, either before or after the remaining components are moved into the water.

Changes may be made in the construction, operation and arrangement of the various parts, elements, steps and procedures described herein without departing from the spirit and scope of the invention as defined in the following claims.

What is claimed is:

1. A marina comprising a main walk, at least one finger walk fixedly connected thereto and angularly disposed therefrom, and floatation means for buoyantly supporting the main walk and finger walk above a body of water;

a unitary structure consisting of a plurality of spaced parallel elongate main frame plates, and a plurality of spaced parallel elongate finger frame plates in underlying relationship with the main frame plates and angularly displaced therefrom;

the main walk comprising a plurality of elongate main frame members each engaging a corresponding main frame plate;

the finger walk comprising a plurality of elongate finger frame members each engaging a corresponding finger frame plate;

means for securing each main frame plate to its corresponding spaced main frame member and in parallel relationship thereto;

means for securing each finger frame plate to its corresponding spaced finger frame member and in parallel relationship thereto;

at least one main walk surface surported by at least two of the main frame members; and at least one finger walk surface surported by at least two finger frame members.

2. The apparatus of claim 1 in which the main frame plates and finger frame plates of said unitary structure are metallic, and the main walk frame members and finger walk frame members are non-metallic.

3. The apparatus of claim 1 in which adjacent ones of said parallel elongate finger frame members are spaced apart by adjacent ones of said spaced parallel elongate finger frame plates positioned intermediate and in engagement with such finger frame members along the length of said finger frame members.

4. The apparatus of claim 3 further comprising at least one metallic finger truss having parallel sides spaced apart a distance equal to the distance said adjacent finger frame members are spaced apart from each other by said finger frame plates, the sides of said finger truss positioned intermediate and in engagement with two of said adjacent finger frame members, and means for securing the sides of said finger truss to respective finger frame members.

5. The apparatus of claim 4 in which said metallic rectangular finger truss and further comprises a diagonally extending member.

6. The apparatus of claim 1 in which the main frame plates of a least one additional unitary structure are secured to the main frame members intermediate two adjacent finger walks, the finger frame plates of each additional unitary structure comprising guiding means for positioning and fixedly securing additional finger walks between existing finger walks.

7. A marina comprising a main walk, at least one finger walk fixedly connected thereto and angularly disposed therefrom, and floatation means for buoyantly supporting the main walk and finger walk above a body of water;

the main walk comprising a plurality of spaced elongate main frame members and at least one main walk surface supported by at least two of the main frame members;

the finger walk comprising a plurality of spaced elongate finger frame members and at least one finger walk surface supported by at least two of the finger frame members;

a plurality of spaced elongate main frame plates at least equal in number to the main frame members with each main frame plate engaging a main frame member along its length;

a plurality of spaced elongate finger frame plates at least equal in number to the finger frame members with each finger frame plate engaging a finger frame member along its length;

means for securing each main frame plate to its corresponding main frame member; means for securing each finger frame plate to its corresponding finger frame member; and means for fixedly securing the spaced main frame plates in angular relationship with the spaced finger frame plates, with the finger frame plates lying below the main frame plates.

8. The apparatus of claim 7 in which the main frame plates and finger frame plates are in direct engagement with each other.

9. The apparatus of claim 7 in which the finger frame plates are secured to the lower portion of the main frame members and form an unrestricted utility conduit along the entire length of the main walk, the conduit being defined on the sides by the main walk members and on the top and bottom by the main walking surface and finger frame plates, respectively.

10. A marina comprising a main walk, at least one finger walk fixedly connected thereto and angularly disposed therefrom, and floatation means for buoyantly supporting the main walk and finger walk above a body of water;

the main walk comprising a plurality of spaced elongate main frame members and at least one main walk surface supported by at least two of the main frame members;

the finger walk comprising a plurality of spaced elongate finger frame members and at least one finger walk surface supported by at least two of the finger frame members;

a plurality of main frame spacing structures and means for securing them to the main frame members to space and maintain the main frame members in spaced parallel relationship with each other;

a plurality of finger frame extension elements equal in number to the finger frame members and means for securing the finger frame extension elements to respective finger frame members, with each finger frame extension element in underlying engagement with a finger frame member along its length; and means for securing each finger frame extension element in spaced apart relationship with each other and in underlying relationship to each main frame member to fixedly secure the spaced main frame members in angular relationship with the spaced apart finger frame members.

11. The apparatus of claim 10 in which each main frame spacing structure consists of a plurality of spaced elongate main frame plates, means for securing each main frame plate to its corresponding main frame member, a plurality of spaced transverse plates, and means for fixedly securing each main frame plate to each transverse plate.

12. The apparatus of claim 11 in which each spaced transverse plate is secured in underlying relationship to each main frame plate.

* * * * *